United States Patent [19]

Ernest

[11] 4,128,668

[45] Dec. 5, 1978

[54] METHOD OF REMOVING EXCESS LIQUID COATING FROM WEB EDGES IN LIQUID COATING THICKNESS CONTROL

[75] Inventor: Robert T. Ernest, Valparaiso, Ind.

[73] Assignee: National Steel Corporation, Pittsburgh, Pa.

[21] Appl. No.: 737,024

[22] Filed: Oct. 29, 1976

Related U.S. Application Data

[60] Division of Ser. No. 685,801, May 12, 1976, which is a continuation of Ser. No. 540,599, Jan. 13, 1975, abandoned.

[51] Int. Cl.[2] ..... B05D 3/04

[52] U.S. Cl. ..... 427/349; 118/63; 118/419; 427/434 C

[58] Field of Search ..... 427/348, 377, 349, 430–437; 118/63, 21, 419; 34/23, 29, 34, 160, DIG. 13; 134/64 R, 64 P, 122 R, 122 P; 15/256 A, 420, 415 A, 306 A, 405, 316 R; 239/597, 552, 566

[56] References Cited

U.S. PATENT DOCUMENTS

| | | | |
|---|---|---|---|
| 448,888 | 3/1891 | Salmon | 36/160 X |
| 1,140,873 | 5/1915 | Carter | 427/349 X |
| 3,499,418 | 3/1970 | Mayhew | 427/349 X |

*Primary Examiner*—Morris Kaplan
*Attorney, Agent, or Firm*—Shanley, O'Neil and Baker

[57] ABSTRACT

This method involves impinging fluid against a liquid coating on opposite surfaces of a moving web with the fluid impinging against the liquid coating across the width of the web to control the liquid coating thickness so that on either side of the center of the web there is a component of motion of the fluid toward each associated edge of the web, whereby excess liquid coating on the web has a component of motion toward each edge of the web.

2 Claims, 17 Drawing Figures

FIG. 8
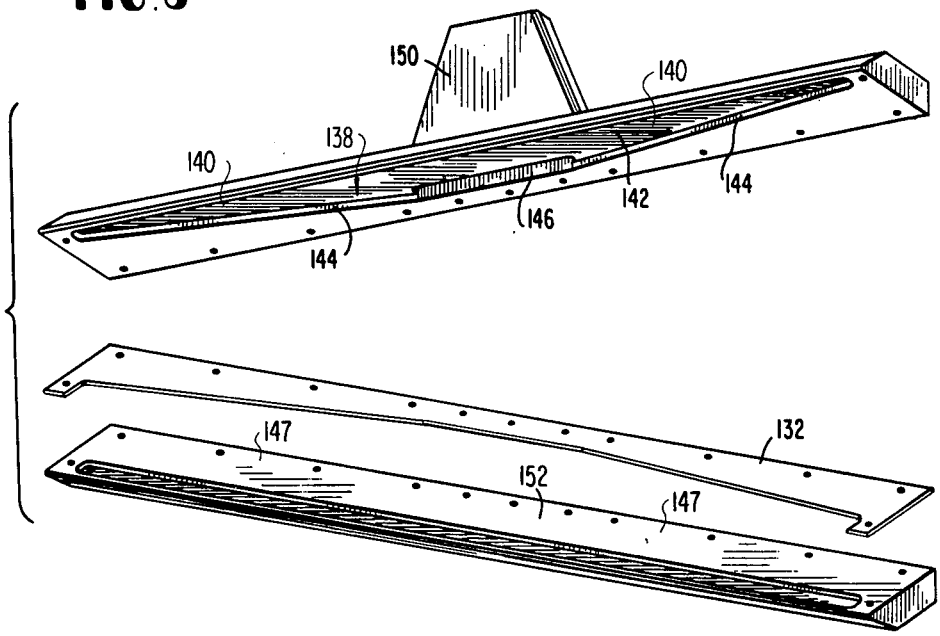
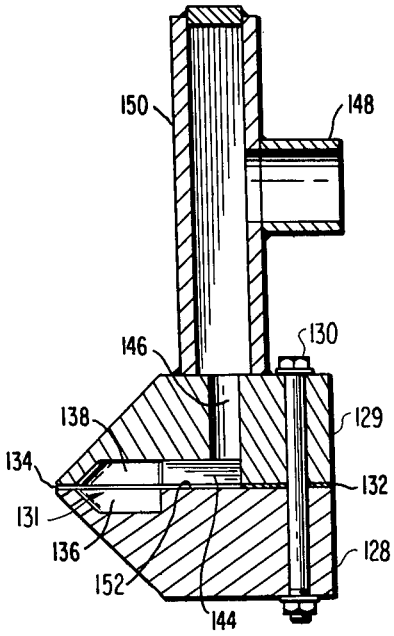
FIG. 9
FIG. 10
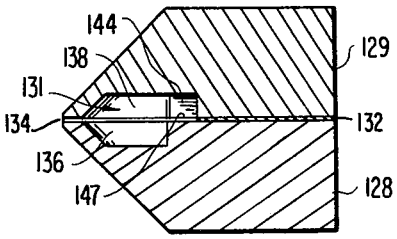

METHOD OF REMOVING EXCESS LIQUID COATING FROM WEB EDGES IN LIQUID COATING THICKNESS CONTROL

RELATED APPLICATION

This application is a division of application Ser. No. 685,801, filed May 12, 1976 which in turn is a continuation of application Ser. No. 540,599, filed Jan. 13, 1975 and now abandoned.

BACKGROUND OF THE INVENTION

In hot metal dip coating processes for metals such as zinc and aluminum and in the coated paper and film industries, the thickness of the liquid coating remaining on the metal strip, film or paper web, all three being herein sometimes generically referred to as webs, must be controlled to obtain a satisfactory product. One of the difficulties encountered in obtaining a web with uniform liquid coating thickness is the occurrence of heavy edge coating, a phenomenon that has become known as edge effect. In this phenomenon, due to the complexities of fluid flow from the opposing nozzles at the edges of the web, the liquid coating remaining on the web is heavier close to and along the edges or marginal portions of the web. Much effort has been expended in attempting to eliminate this difficulty.

United States patents proposing solutions for eliminating edge effect are U.S. Pat. Nos. 3,406,656, 3,480,469, 3,526,204, 3,670,695, 3,672,324, 3,687,103, 3,742,905, 3,773,013.

In addition to the waste of coating material and other problems which result from edge effect in the coated metal paper and film environments, in the metal coating industry where the strip metal such as steel is coated with coating metal such as zinc and aluminum a further very serious difficulty arises from edge effect. The coated metal strip is coiled as it is produced for convenience in handling and shipping. The slightly thicker coating metal at the edges of the strip results in "spooling" in the usual large coil. In spooling the strip assumes a concave configuration as the coil builds up. Spooling is a very serious defect because it can cause the strip edges to be stretched plastically resulting in a wavy edge when the strip is uncoiled. Such strip is commercially unacceptacle.

Several of the above cited U.S. patents attempt to explain the phenomena which result in edge effect in strip or web coating. Regardless as to what explanations are correct, applicant has discovered that by impinging against a moving web coated with liquid a stream of fluid which has a component of motion toward each edge of the strip or web, edge effect in the finally coated product can be greatly reduced or even entirely eliminated and for practical purposes substantially uniform coating thickness obtained across the width of the web.

SUMMARY OF THE INVENTION

The present invention is the discovery that fluid from opposing nozzles impinging against a moving web to control the thickness of coating liquid on the web will ameliorate or eliminate edge effect when the fluid has a component of motion toward each edge of the web sufficient to cause excess liquid coating in the vicinity of each edge of the web to have a component of motion toward each edge of the web (in addition to the component of motion of excess liquid coating downwardly) to thereby obtain substantially uniform liquid coating thickness across the width of the web.

The present invention covers the method of removing excess coating from one surface of a travelling web or substrate comprising supplying a source of fluid under pressure, forming a stream of the fluid, shaping the stream of fluid so as to form a single, unitary stream which impinges against the one surface of the web across the width thereof to remove excess liquid coating from the one surface, determining or controlling the direction of fluid movement in the stream of fluid impinging against the one surface of the web to cause movement of excess liquid coating on the traveling web outwardly toward the longitudinal edges of the web.

BRIEF DESCRIPTION OF THE DRAWINGS

FIG. 8 is an exploded view of the modified form of nozzle illustrated in FIG. 7;

FIG. 9 is a view in cross section similar to FIG. 5 of the nozzle of FIG. 8;

FIG. 10 is a view in cross section similar to FIG. 6 of the nozzle of FIG. 8;

DETAILED DESCRIPTION

Although the present invention is applicable to the production of imperforate webs such as coated paper, photographic film and metal strip coated with metals other than zinc, the invention will be described in the environment of continuous galvanizing, the principles of application to the other environments being obvious from the ensuing description of the invention in the galvanizing art.

Figure 2:
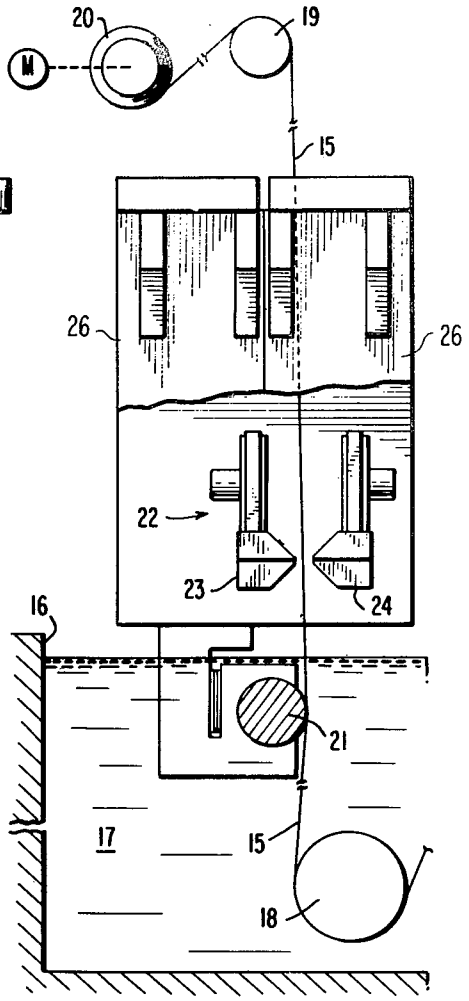
FIG. 2 is a fragmentary side elevational view of the apparatus of FIG. 1 with parts broken away better to illustrate the embodiment.
Figure 1:
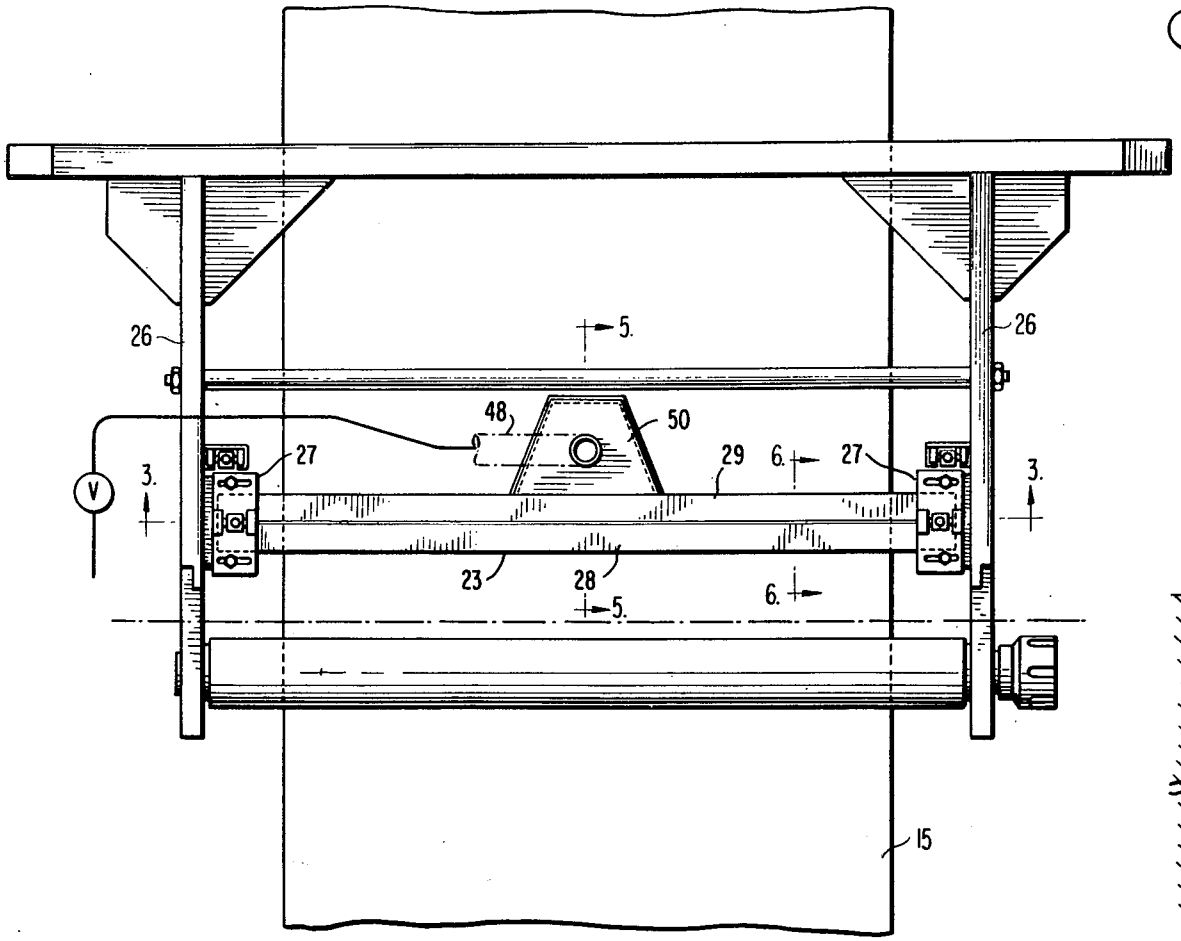
FIG. 1 is a fragmentary view in elevation of a liquid coating thickness control system embodying the present invention and for carrying out the method of the present invention.
Figure 3:
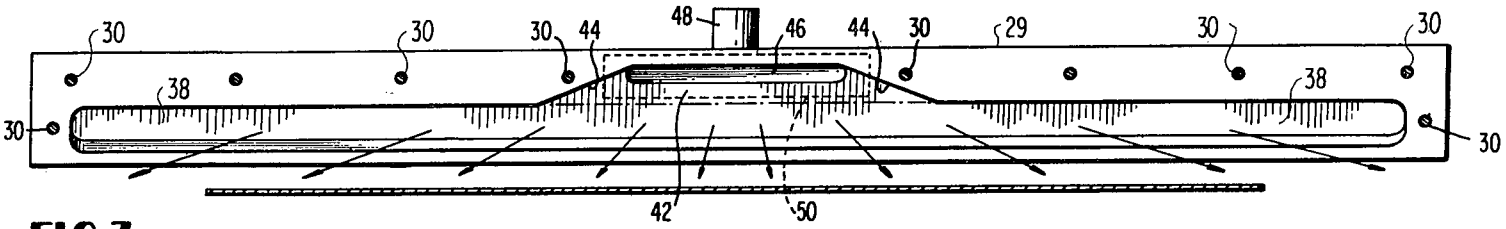
FIG. 3 is a fragmentary view in cross section taken on the line 3—3 of FIG. 1 with parts removed for simplification.
Figure 7:
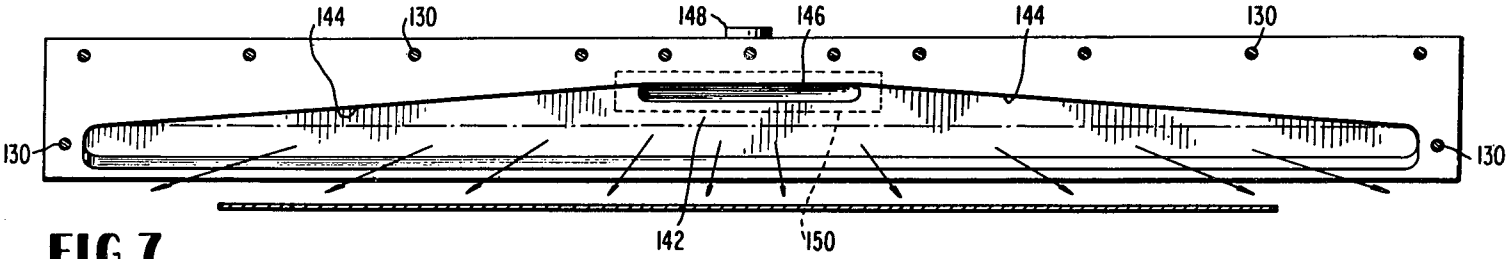
FIG. 7 is a fragmentary view in cross section similar to FIG. 3 illustrating a modified form of nozzle.

Referring especially to FIGS. 1 and 2, steel strip 15 is shown traversing a galvanizing pot 16 holding a spelter bath 17. The path of travel of the strip is established by a sequence of guide rolls around which the strip is led. The rolls include sink roll 18 and change-of-direction roll 19, the latter being far enough above the bath so that the molten spelter on the strip has solidified by the time the strip reaches roll 19. A motor driven coiler 20 draws the strip through the galvanizing apparatus. A stabilizing roll 21 near the surface of the spelter bath presents the strip in planar form to a coating thickness control apparatus, indicated generally by reference numeral 22, the uniform spacing between the strip and the coating thickness control nozzles 23 and 24.

The liquid coating thickness control system involving nozzles 23 and 24 and its operation are described in detail in U.S. Pat. No. 3,499,418, the disclosure of which patent in this respect is incorporated in the present application by reference.

Briefly, strip 15 issuing upwardly from the spelter bath carries on each of its surfaces a layer or coating of molten coating metal. In the coating thickness control zone defined by nozzles 23 and 24, the thickness of the coatings on the two sides of strip 15 is controlled by wiping excess coating metal back into the bath 17. This is effected through streams of gas under pressure issuing from the nozzles in accordance with the basic principles taught in U.S. Pat. No. 3,499,418.

Nozzles 23 and 24 form part of a coating thickness control rig which includes frame members 26, 26 and associated adjustable nozzle support structures 27, 27 which support the nozzles 23, 24 for needed movement with nozzle 23 on one side of the strip travel path and with nozzle 24 on the opposite side of the travel path at approximately the same height as nozzle 23 with each nozzle facing the associated surface of the steel strip. The nozzles can be identical and therefore description of one nozzle will suffice for an understanding of both.

Referring now to FIGS. 3–6, nozzle 23 has an elongated body member made up of a lower die 28 and an upper die 29 which as will be further described enclose between them an elongated cavity or phenum chamber, indicated generally by reference numeral 31, when they are assembled as shown in FIGS. 1, 2, 5 and 6. The upper and lower dies are held together by bolts 30 which are shown in section in FIG. 3 and an elongated shim 32 (FIG. 4) is positioned between the dies at the ends and rear of the nozzle to form the nozzle fluid emitting orifice 34 (FIGS. 5 and 6) through which fluid or gas is emitted from the nozzle to impinge against the liquid coating on the surface of strip 15. Fluid emitting orifice 34 comprises a long passageway 35 having planar walls which are parallel to each other, the length of the passageway from the plenum chamber fluid entrance opening side to the fluid exit opening side, i.e., in a plane normal to the length dimension of the body member being at least several times its width or height in such plane as defined by shim 32. Other forms of orifices can be used if desired.

The plenum chamber 31 enclosed by dies 28 and 29 is shown in the form of nozzle illustrated to be formed by a cavity 36 in die 28 and a cavity indicated generally by reference numeral 38 in die 29, the two cavities acting together to make up the plenum chamber 31 within the nozzle. The cavity 36 in die 28 can be merely an elongated trough with the forward wall sloping toward the nozzle orifice 34. The cavity 38 on the other hand, in the illustrated embodiment, has similar end portions 40 corresponding in shape inversely to the end portions of cavity 36. However, the central portion of cavity 38 extends rearwardly of the nozzle to form an enlarged central portion 42 defined by forwardly diverging walls 44 which just clear two of the bolts 30 which hold the dies together. Farthest back from the nozzle orifice in cavity 42, an elongated inlet gas or fluid admission port 46 opens into cavity 38, inlet gas port 46 having a fluid flow direction perpendicular to the exposed portion 52 of the upper surface 47 of die 28 in that centrally located portion of the plenum chamber formed by enlarged cavity 42 of die 29. Gas admission port 46 is elongated along the length of die 29 in order to have as large a gas inlet port as practicable as far back in die 29 as practicable within the limits of the die structures 28 and 29, while still confining the gas inlet port to the central or intermediate portion of the plenum chamber formed by cavities 36 and 38.

In order to supply gas under pressure to gas inlet port 46 with the gas distributed as uniformly as practicable over the entire area of port 46, conventional high pressure gas or fluid supply cylindrical conduit 48 is connected to inlet gas port 46 through a gas flow equalizing chamber 50.

It will be noted that the portion 52 of the planar upper surface 47 of lower die 28 coinciding with portion 42 of cavity 38 forms a baffle, the boundaries of which are defined by walls 44. This baffle 52 is shown disposed at right angles to the flow of gas entering the plenum chamber 31 of the nozzle formed by recesses 36 and 38. In the narrow bodied nozzle of FIGS. 3 to 6, the diverging angle which walls 44 assume is governed by the two adjacent bolts 30 which are needed to hold the dies in sealing relationship with each other. Thus this angle is made as wide as practicable in the circumstances. On the other hand, where the nozzle can be made deeper or in other words the dies made wider, the more ideal angle shown in the modified structure of FIGS. 7 to 10 can be adopted.

It will be evident from the foregoing that the gas or fluid impinging on baffle 52 will have its direction of flow changed and that the internal surfaces of plenum chamber 31, including walls 44, will determine the direction of movement of the gas toward and through fluid emitting orifice 34 and that this direction of movement of the gas in each end zone of chamber 31 will have an outward component toward the associated marginal portion of the strip, in addition to a component toward the surface of the strip.

Since the modified structure of FIGS. 7 to 10, aside from the angle of walls 44 is the same as that of FIGS. 1 to 6, a description of this modification has been obviated by assigning the same reference numerals to similar parts in the FIGS. 7 to 10 embodiment as in the FIGS. 3–6 embodiment with 100 being added to each reference numeral in FIGS. 7–10.

The baffle means in the plenum chamber formed by surfaces 52 and 152 are shown as being coplanar with the plane of symmetry of the fluid emitting orifice passageway. Satisfactory operation can be achieved with the lower die 28 or 128 being milled out so as to form a cavity in the lower die which is the same shape as cavity 38 or 138. In such case the baffle means would be the floor of the additionally milled out portion of lower die 28 or 128 corresponding to cavity area 47 or 147 in the embodiments already described.

Such a modification is illustrated in FIGS. 11 to 14. In the modification illustrated in these figures the same reference numerals are applied to similar parts as in FIGS. 7 to 10 with 100 being added to each reference numeral to FIGS. 11 to 14.

Comparison of the third embodiment illustrated in FIGS. 11 to 14 with the embodiment illustrated in FIGS. 7 to 10 shows that baffle 152 of the earlier described embodiment, indicated by reference numeral 252 in the third embodiment, has been lowered in the third embodiment to the same elevation as the bottom wall of cavity 136 in die 128 of the second embodiment. At the same time the walls of fluid admission port 146 of the earlier described nozzle have been flared outwardly as shown at 245, 245 in connection with fluid admission port 246 of the modification illustrated in FIGS. 12 to 15. Although the smallest cross-sectional area of fluid admission port 246, where it is in communication with fluid pressure equalizing chamber 250, remains the same as in the preceding embodiments, flared wall portions 245 reduce the turbulence and resulting throttling effect in fluid admission port 246 as compared to the earlier described embodiments. Under most conditions of operation the flared fluid admission port 246 and the lowered baffle 252 result in a more uniform distribution of fluid flow out of the fluid emitting orifice along the length of the nozzle. Flared wall surfaces 245 act to diffuse the gas passing through fluid admission port 46 outwardly so that the gas has a component of movement in the direction of the end portions of the plenum chamber to thereby cut down on turbulence in plenum 231 at the point of entry of the fluid into the plenum chamber and its impingement on baffle 252. Where it is desired, the action of flared surfaces 245 can be augmented by vanes similarly disposed within port 246 to reduce turbulence of the gas impinging on baffle 252 as the fluid changes direction and moves toward the extremities of the nozzle. By the same token port 246 can be made up of a plurality of contiguous ports to give the same effect as single port 246 with or without vanes.

The structure of FIGS. 11–14 reduces the tendency of the nozzle to give a lighter coating weight in the central portion of the coated strip. It also increases the outward component of movement of the fluid toward the outer portions of the nozzle and hence the component of fluid motion through the fluid emitting orifice in the direction of the edges of the strip. This is by virtue of the reduction in turbulence in the central portion of the nozzle and the greater streamlined effect of fluid moving downwardly and outwardly from the enlarged opening of fluid admission port 246. Although the angle of flare of the end wall portions of fluid admission port 246 illustrated at 245, 245 is shown as 45°, this angle is not critical and of course the flared port walls can be further streamlined by curving them outwardly if desired. Operation of the nozzle of this embodiment is best when the flare shown at 245 is present only in the direction of the longitudinal dimension of the nozzle, the width dimension of port 246 in the width dimension of the fluid admission port preferably being uniform as in the previous embodiments.

It will be apparent from the foregoing that the fluid admission port in the embodiment of FIGS. 11–14 comprises a portion having the smallest cross-sectional area and a portion flared or streamlined in the direction of the length dimension of the nozzle.

Figure 17:
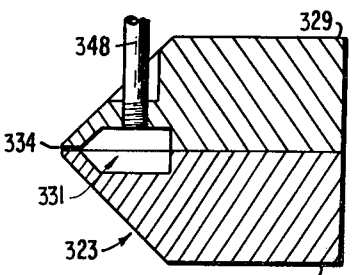
FIG. 17 is a cross sectional view taken on the line 17—17 of FIG. 15.
Figure 15:
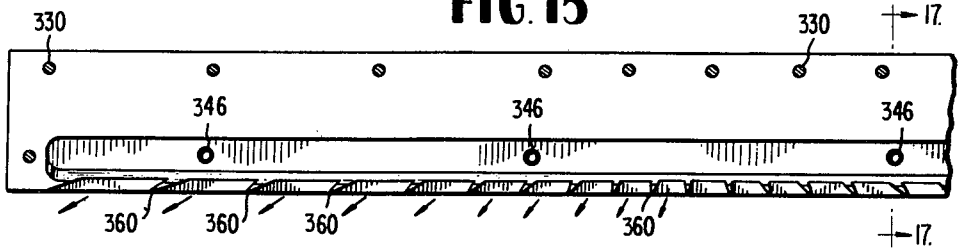
FIG. 15 is a view similar to FIGS. 3 and 7 of a further modified form of apparatus useful for carrying out the method of the present invention.
Figure 16:
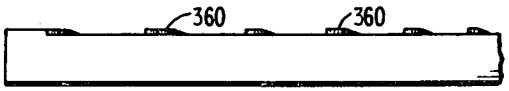
FIG. 16 is a fragmentary front elevational view of the apparatus of FIG. 11.
Figure 4:
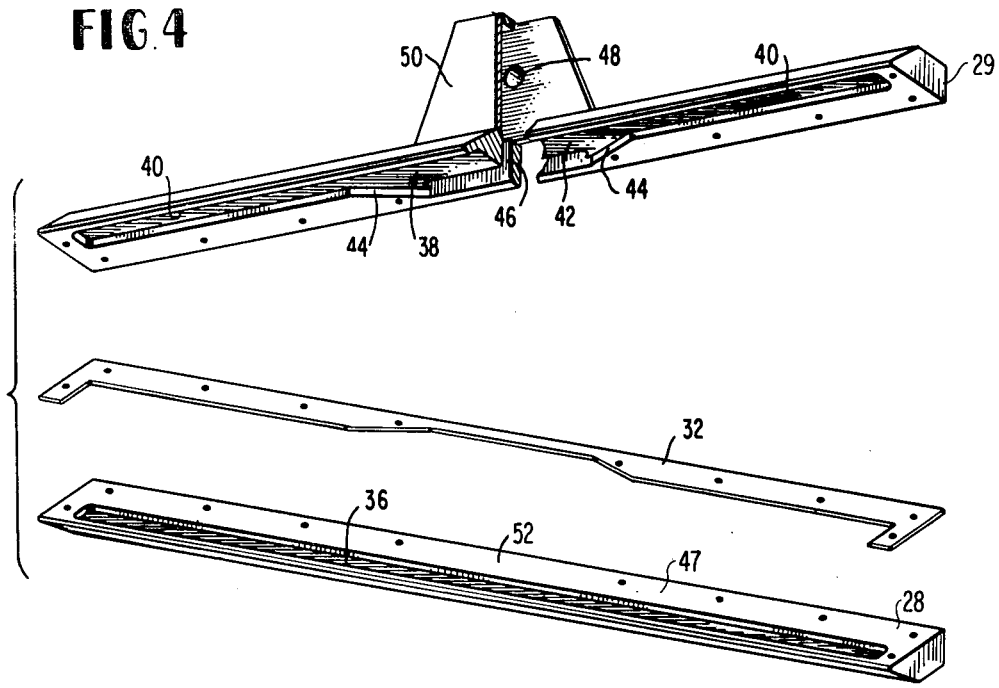
FIG. 4 is an exploded view of a nozzle constituting an embodiment of the present invention.
Figure 5:
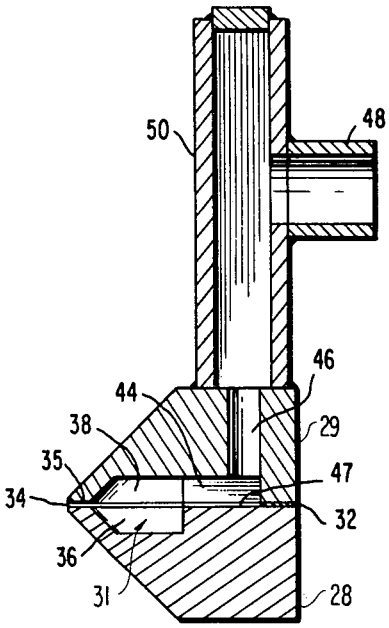
FIG. 5 is a fragmentary view in cross section taken on the line 5—5 of FIG. 1.
Figure 6:
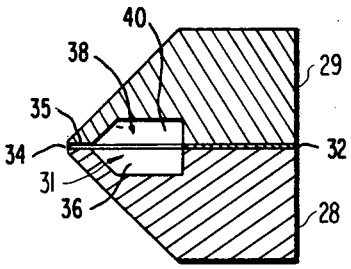
FIG. 6 is a fragmentary view in section taken on the line 6—6 of FIG. 1.
Figure 12:
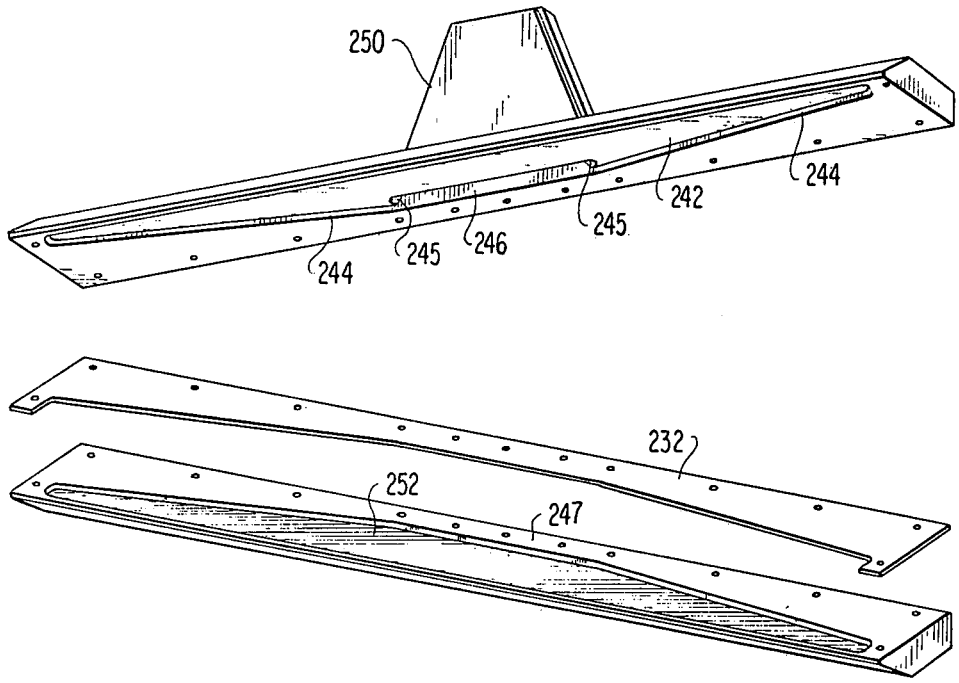
FIG. 12 is an exploded view of the further modified form of nozzle illustrated in FIG. 11.
Figure 13:
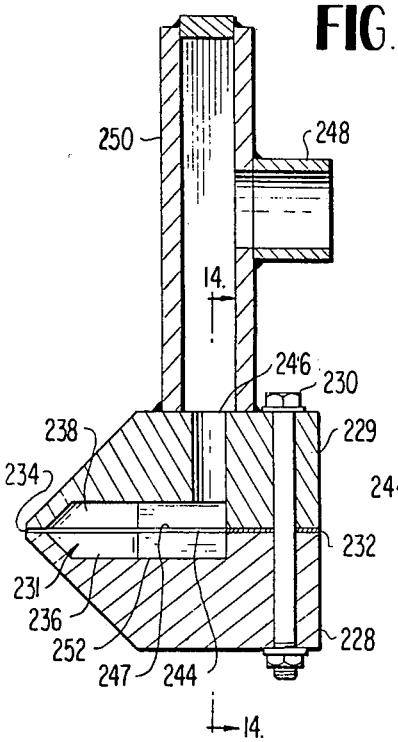
FIG. 13 is a view in cross section similar to FIG. 5 of the nozzle of FIG. 12.
Figure 14:
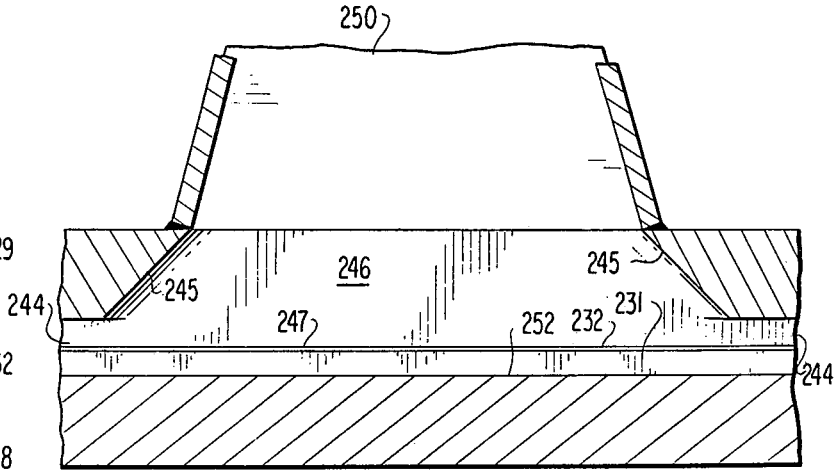
FIG. 14 is a fragmentary view taken on the line 14—14 of FIG. 13.
Figure 11:
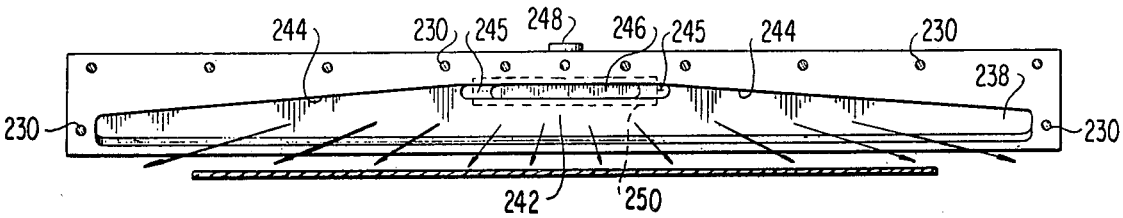
FIG. 11 is a fragmentary view in cross section similar to FIGS. 3 and 7 illustrating a further modified form of nozzle.

FIGS. 15 to 17 disclose another form of apparatus for carrying out the method of this invention, namely the impingement of gas on the liquid coating on a strip or web to remove excess liquid coating in such a way as to move coating laterally of the length of the strip or web toward the marginal portions of the strip or web. Here again in the description of this modification the same reference numerals are used for similar parts as in the description of the first embodiment with 200 being added. It will be noted that the nozzle 323 of the FIGS. 15 to 17 modification is similar to that illustrated in U.S. Pat. No. 3,499,418, FIG. 4 but instead of a shim being used to space the component dies making up the nozzle, the wall forming the passageway of the fluid emitting orifice in the upper die has portions milled out to form streamlined vanes 360. The gas passes out through the milled-out portions and vanes 360 are shaped to change the direction of the gas so that the gas impinges on the liquid coating on the web with an outwardly sweeping motion. Vanes 360 are shown exaggerated in thickness in the drawing; their width should be extremely narrow so as not to break down the single wide stream of gas into discrete streams. Obviously vanes 360 constitute baffle means disposed in the path of the gas passing through the nozzle.

The following table gives examples of satisfactory gas pressures, nozzle-to-strip spacings and ranges of important nozzle dimensions.

| | Inches | cm |
|---|---|---|
| Nozzle-to-Strip Spacing | .25–1.5 | .635–3.81 |
| Nozzle Fluid Exit Opening Width (or Height) | .010–.15 | .0254–.381 |
| Nozzle Fluid Emitting Orifice Length | 30–72 | 76.2–182.88 |
| Nozzle Fluid Inlet Port Width | .5–1 | 1.27–2.54 |
| Nozzle Fluid Inlet Port Length | 12–24 | 30.48–60.96 |
| Fluid Supply Conduit Diameter | 1–2.5 | 2.54–6.35 |
| | lb/in2 | Kg/cm2 |
| Fluid Pressure | 5–80 | .352–5.624 |

The foregoing described liquid coating thickness control apparatus of FIG. 1 to 6 has been found by applicant to do a very satisfactory job in galvanizing at moderate strip speeds and gas pressures. The nozzle modification illustrated in FIGS. 7 to 14 is even more efficacious in view of the wider fluid diffusing action of wall portions 144. However, other forms of nozzles incorporating principles of the present invention can be used, similar to those illustrated in FIGS. 1 to 14, for carrying out the method of the present invention and not as radically different as that illustrated in FIGS. 15–17. Such other nozzles would have one central fluid inlet port to a plenum chamber, such as fluid inlet ports 46, 146 and 246, but with the nozzle made still deeper the fluid inlet port could be farther back from the nozzle orifice and need not be so elongated, if elongated at all. In such case, walls the equivalent of walls 144 would have a similar angle in respect to each other.

An advantage of the nozzle structures of FIG. 1 to 14 which would be lost by such other modified forms would be the board stream of incoming gas, shaped by fluid admission ports 46, 146 and 246 so as to have a long dimension along the length of the nozzle orifice and therefore across the width of the web, together with the resulting distribution of the highest pressure zone in the plenum chamber over a longer portion of the length of the nozzle orifice. From inspection of FIGS. 4–14, it will be apparent that the smallest cross sectional area of each of the fluid admission ports 46, 146 and 246 has a length dimension several times its width dimension. In a compact nozzle, the beneficial effects of the elongated fluid inlet port on the over-all uniformity of liquid coating removal across the width of the web is of importance in practice. Although applicant is not to be limited to the theory involved, it is believed this is because the mass impact effect of the incoming flow of fluid into the plenum chamber at any point along the length of the entrance to the fluid emitting orifice varies as the square of the distance between that point and the nearest point of the fuid inlet port. Thus by having an elongated fluid inlet port extending parallel to the nozzle orifice, the mass impact effect of the moving gas in the plenum chamber is uniformly distributed over a wide portion of the nozzle fluid emitting orifice and this in turn tends to keep the central portion of the web from having a final coating thickness which is objectionably less than the remainder of the width of the web. It will be recognized that in everyday practice a slightly thinner coating in the intermediate portion of the web need not necessarily be objectionable.

Optimum results are achieved with the nozzles of the present invention when the smallest cross-sectional area of the fluid admission port is several times greater than the smallest cross-sectional area of the fluid emitting orifice.

It has already been proposed in the galvanizing art to eliminate edge effect by the utilization of a nozzle which curves toward the strip from the central portion of the web to the edge portions of the web. This type of nozzle has not eliminated objectionable edge effect because edge effect is caused by a heavy coating on the web very close to the edge. What the curved nozzle probably does is to increase the thickness of the coating on the web in the central portion of the web and this thicker coating in the central portion of the web has prevented spooling by virtue of the excess coating on the central portion of the web preventing the strip from assuming the concave configuration which is the objectionable feature of spooling. This excess coating is otherwise wasted, an expensive expedient.

Where under some operating conditions there would be too much removal of liquid coating in the central portion of the web with applicant's nozzle, the fault can be remedied by imparting to applicant's nozzle a so-called curved shape, with the amount of curvature such as to build up the central portion of the coating on the web to the desired thickness, not an excess thickness. Thus the nozzles of FIGS. 4 and 8 can where desired be given a curvature which will result in a satisfactory coating thickness across the width of the web and applicant has operated with this form of nozzle. The degree of curvature was so slight as not to be evident in the accompanying drawings. In applicant's operations using the so-called curved nozzle, with the form of nozzle illustrated in FIG. 4, the central 18 inch portion of the orifice of the nozzle was straight and parallel to the strip; the next 18 inch portion (9 to 27 inches from the center of the nozzle) of the orifice was tapered along a straight line departing ¼ of an inch per foot toward the strip from the straight central portion of the orifice. The outermost 3 inch portion of the nozzle orifice was again straight in a line parallel to the central portion of the nozzle orifice. Thus the 18-inch central portion of the nozzle orifice was 0.375 inch farther removed from the strip than the edge portions or in other words the central portion of the fluid emitting orifice is spaced rearwardly from a straight line extending between the ends of the fluid emitting orifice. This so-called curved die was representative of applicant's invention but the dimensions of taper can be changed to accommodate the parameters involved, including speed of the strip, distance of travel of the fluid from the nozzle to the strip, the pressure of the fluid, so as to obtain the optimum practical uniformity of the liquid coating thickness across the width of the strip.

Of course where the central portion of the strip would have a thinner coating over say a 12-inch portion, the central portion of the nozzle would be spaced away from the strip over a length of nozzle orifice and at a distance from the strip which would result in a commercially satisfactory uniformity of coating thickness across the width of the strip. The important aspect is that the so-called curved die configuration can adequately control the coating thickness except for edge effect and since applicant's outwardly sweeping gas flow can control edge effect, the two phenomena can be combined where desirable to solve any coating thickness uniformity problem within practical limits.

The described method is to be considered in all respects as illustrative and not restrictive since the invention may be carried out in other ways without departing from its spirit or essential characteristics. Therefore the scope of the invention is indicated by the claims rather than by the foregoing description, and all changes which come within the meaning and range of the equivalents of the claims are intended to be embraced therein.

I claim:

1. A method of removing excess liquid coating from both surfaces of a moving, continuous imperforate web issuing from a bath of liquid coating of the type that will harden to form a solid coating on a substrate while preventing objectionable residual heavier liquid coating from remaining on the longitudinal marginal portions of the surfaces of the web comprising providing fluid under pressure, forming a pair of opposed streams of fluid under pressure arranged respectively on each of the opposite surfaces of the moving web, forming each stream of the pair of opposed streams of fluid under pressure in a nozzle having an elongated plenum chamber and a fluid emitting orifice forming means having an opening facing toward the associated surface of the web and extending across the width of the associated surface of the web for connecting the plenum chamber with the exterior of the nozzle so as to form a continuous steam extending across the width of the associated surface of the moving web at least from one longitudinal edge to the other longitudinal edge of the web, impinging the opposed streams of fluid under pressure respectively against the associated opposite surfaces of the moving web to remove excess liquid coating from the opposite surfaces of the web, determining the direction of movement of the fluid under pressure in each stream by shaping each stream of fluid under pressure in the nozzle, the direction of movement of the fluid under pressure in each stream being determined at least in part by admitting fluid under pressure into the intermediate portion only of the elongated plenum to cause the fluid under pressure in each end portion of the plenum chamber to have a component of motion parallel to the length dimension of the plenum chamber and a component of motion normal to the associated surface of the web to thereby impart to the fluid under pressure issuing from the fluid emitting orifice forming means and impinging on the two marginal portions of the associated surface of the web movement in respect to each marginal portion having a component normal to the surface of the marginal portion of the web and a component parallel to the surface of the marginal portion of the web and in a direction toward the associated longitudinal edge of the web to cause movement of excess liquid coating on the surface of each of the two marginal portions of the web downwardly and outwardly toward the respective longitudinal edges of the web to thereby eliminate objectionable residual heavier liquid coating on the longitudinal marginal portions of the surfaces of the web.

2. A method of removing excess liquid coating from both surfaces of a moving, continuous imperforate web issuing from a bath of liquid coating of the type that will harden to form a solid coating on a substrate while preventing objectionable residual heavier liquid coating from remaining on the longitudinal marginal portions of the surfaces of the web comprising providing fluid under pressure, forming a pair of opposed streams of fluid under pressure arranged respectively on each of the opposite surfaces of the moving web, forming each stream of the pair of opposed streams of fluid under pressure in a nozzle having a plenum chamber and a fluid emitting orifice forming means having an opening facing toward the associated surface of the web and extending across the width of the associated surface of the web for connecting the plenum chamber with the exterior of the nozzle so as to form a continuous stream extending across the width of the associated surface of the moving web at least from one longitudinal edge of the other longitudinal edge of the web, impinging the opposed streams of fluid under pressure respectively against the associated opposite surfaces of the moving web to remove excess liquid coating from the opposite surfaces of the web, determining the direction of movement of the fluid under pressure in each stream by shaping each stream of fluid under pressure in the nozzle, the direction of movement of the fluid under pressure in each stream being determined at least in part by admitting the fluid under pressure into the plenum chamber and impinging fluid under pressure against baffle means disposed in the path of fluid under pressure as the fluid under pressure passes through the nozzle to change the direction of movement of fluid under pressure, and cause the fluid under pressure leaving each end portion of the fluid emitting orifice forming means to have a component of motion parallel to the length dimension of the plenum chamber and a component of motion normal to the associated surface of the web to thereby impart to the fluid under pressure impinging on the two marginal portions of the associated surface of the web movement in respect to each marginal portion having a component normal to the surface of the marginal portion of the web and a component parallel to the surface of the marginal portion of the web and in a direction toward the associated longitudinal edge of the web to cause movement of excess liquid coating on the surface of each of the two marginal portions of the web downwardly and outwardly toward the respective longitudinal edges of the web to thereby eliminate objectionable residual heavier liquid coating on the longitudinal marginal portions of the web.

* * * * *

UNITED STATES PATENT OFFICE

CERTIFICATE OF CORRECTION

Patent No. 4,128,668 Dated December 5, 1978

Inventor(s) Robert T. Ernest

It is certified that error appears in the above-identified patent and that said Letters Patent are hereby corrected as shown below:

Title page, under "Related U.S. Application Data" after "continuation" insert -- in part --.

under "Abstract" second line, after "web" insert -- to control the liquid coating thickness --; fourth line, after "web" cancel "to control the liquid coating thickness".

Column 1, line 10, after "tion" insert -- in part --;
line 35, after "metal" insert a comma (,).

Column 2, line 4, after "excess" insert -- liquid --.

Column 3, line 40, change "phenum" to -- plenum --.

Column 7, line 7, change "fuid" to -- fluid --.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*